United States Patent [19]

Tholander

[11] 4,403,745

[45] Sep. 13, 1983

[54] THREAD STORING AND FEEDING DEVICE

[75] Inventor: Lars H. G. Tholander, Huskvarna, Sweden

[73] Assignee: Aktiebolaget IRO, Ulricehamn, Sweden

[21] Appl. No.: 307,987

[22] Filed: Oct. 2, 1981

[30] Foreign Application Priority Data

Oct. 2, 1980 [SE] Sweden ..... 8006886

[51] Int. Cl.[3] ..... B65H 51/20

[52] U.S. Cl. ..... 242/47.01; 242/47.05

[58] Field of Search ..... 242/47.01, 47.04, 47.05, 242/47.06, 47.07, 47.12; 66/132 R; 139/452

[56] References Cited

U.S. PATENT DOCUMENTS

| | | | |
|---|---|---|---|
| 2,210,914 | 8/1940 | Knebusch | 242/47.05 |
| 2,289,390 | 7/1942 | Torrence et al. | 242/47.05 |
| 2,425,136 | 8/1947 | Torrence | 242/47.05 |
| 2,651,828 | 9/1953 | Eidman et al. | 242/47.05 |
| 3,687,384 | 8/1972 | Rosen | 242/47.12 |
| 3,709,444 | 1/1973 | Tannert | 242/47.04 |
| 4,047,675 | 9/1977 | Jacobsson | 242/47.01 |
| 4,102,509 | 7/1978 | Paepke | 242/47.04 |

FOREIGN PATENT DOCUMENTS

| | | |
|---|---|---|
| 1258809 | 1/1968 | Fed. Rep. of Germany . |
| 381622 | 10/1964 | Switzerland . |
| 2069016 | 8/1981 | United Kingdom . |

*Primary Examiner*—Stanley N. Gilreath

*Attorney, Agent, or Firm*—Flynn, Thiel, Boutell & Tanis

[57] ABSTRACT

A thread storing and delivery device comprising a storage body consisting of two bar drums which is rotated in response to the amount of a thread store wound on. Both bar drums interengage. The one is driven by the other bar drum. The other bar drum is swivelable journalled eccentrically and inclined with respect to the rotational axis of the storage body and is provided with an integral friction lining adapted to engage a complimentary friction lining of a drive shaft belonging to the drive means in response to the relative displacement of the other bar drum dependent from the wrapping force of the thread store.

19 Claims, 3 Drawing Figures

THREAD STORING AND FEEDING DEVICE

FIELD OF THE INVENTION

This invention relates to a thread storing and feeding device of the type defined in the generic clause of the main claim.

BACKGROUND OF THE INVENTION

In a thread storing and feeding device known from CH-PS No. 381,622, a storage drum is rotated by a drive motor through a belt drive transmission. The storage drum transmits the drive to a feeding body rotatably mounted on a support member determining the eccentricity and inclination of its axis of rotation with respect to that of the storage drum. To this effect the support member is mounted for pivotal movement about two pivot pins extending perpendicular to the storage drum axis. Through a pin-and-slot arrangement the support member is operatively connected to a two-armed lever mounted for rotation about a stationary axis. The arm of said lever facing towards the drive input side of the device cooperates with a pretensioned compression spring urging the lever and thus the feeding body towards the position of greatest inclination of the feeding body axis. The said arm is further pivotally connected to a pair of linkage members operatively connected to stationary switches. The switches control said drive motor in such a manner that a decrease of the inclination of the feeding body causes the rotational speed of the storage drum to be decreased until the thread supply is consumed to such a degree that its wrapping force is no longer sufficient to prevent the feeding body from assuming its inclined position. As the inclination of the feeding body is thus again increased, the drive motor rotates the storage drum at a higher speed until finally the thread supply has grown to such a degree that its wrapping force becomes sufficient to again decrease the inclination of the feeding body. This known device requires a highly complicated structural arrangement for transmitting the movements of the feeding body to the switches for causing the latter to control the speed of the drive motor. In addition, this device is of considerable length and unsuitably heavy. There are a great number of pivot connections and other friction points requiring frequent maintenance and subject to contamination. Finally, the device requires a separate drive motor.

It is an object of the present invention to provide a thread storing and feeding device which is of simple and compact construction, reliable in operation and additionally permits the rotational drive to be operated at constant speed.

According to the solution provided by this invention, a device of the type indicated above requires only very few and simple components for the speed control of the storage body. The drive shaft can be rotated at constant speed. The effective rotational speed of the storage body is determined by the engagement of drive transmitting friction linings which during normal operation assume an equilibrium position with a substantially continuous slip therebetween. Since the other bar drum due to its movable mounting is directly responsible for the speed control, the speed will always be accurately controlled in conformity with the instantaneous amount of the thread supply, i.e. with the wrapping force exerted thereby. A further advantage is offered by the constant speed operation of the rotary drive. The friction surfaces are subjected to a self-cleaning effect and may be very durable. The device is of compact and low-weight construction.

From DE-AS No. 12 58 809 there is indeed known a thread storing and feeding device employing a friction brake for controlling the rotational speed of the storage drum. The principle of operation is completely different, however, as the storage drum is directly coupled to the rotary drive so as to normally rotate at an elevated speed, the friction brake serving to retard the storage drum to the required speed. To this effect, the friction brake causes slippage to occur within the rotary drive, resulting in undesirably high wear therein. This known solution is of extremely complicated construction, in that the amount of the instantaneous thread supply is scanned by pivot levers effective to shift the storage drum via a linkage mechanism until the friction brake is actuated. According to this solution, moreover, the storage drum surface is at the same time formed by the feeding body surface.

A further thread storing and feeding device is also known from GB-PS No. 2,069,016, according to which a friction clutch is disposed betwwen the rotary drive and the storage drum. In this construction the underside of a drive disk of the rotary drive carries a clutch surface cooperating with a second clutch surface disposed on the end face of the storage disk in conformity with the amount of thread stored on the storage drum. The storage drum is spring-biased towards the engagement position of the clutch surfaces and is moved from the drive disk after a sufficient amount of thread is stored.

In accordance with the present invention the exccentricity and the inclination of the other bar drum axis with respect to the axis of rotation of the storage body must be accurately adjustable in order to enable the other bar drum to perform its feeding function as well as its speed control function. Since however the space within the storage body is relatively restricted and rather inaccessible, an embodiment of this invention is of particular advantage. In this embodiment, other bar drum is rotatably mounted on a carrier plate which itself is mounted for movement on a stationary support against a spring bias whereby the eccentricity of the other bar drum with respect to the rotational axis of the storage body can be displaced over a determined range of movement. The carrier plate requires only little space and may without difficulty be located between other components of the device so that the overall length of the latter is not increased and that its proper function is not disturbed.

A further advantageous embodiment has the carrier plate mounted for limited pivotal movement about a stationary pivot axis which is radially spaced from the axis of the storage body and encloses a small acute angle therewith. According to this embodiment, the mounting of the carrier plate is spaced from the axis of the storage body. Due to its acute angle the pivot axis itself determines the inclination and eccentricity of the rotary axis of the other bar drum. A particularly simple structure for attaining this object is characterized by said pivot axis being defined by a pin secured to a stationary mounting member.

The distance of said pin from the axis of the storage body is preferably greater than the radius of the storage body, and this is of importance for enabling the carrier plate and the other bar drum to accurately respond to changes of the wrapping force of the thread supply and for the adjusting forces resulting therefrom to act through a relatively long lever arm. In practice it has been found advantageous to select the distance of the pin from the radius of the other bar drum in a relationship within the range of 1:1.5 to 1:2.

A further advantageous embodiment of the invention has the carrier plate cooperating with a stop in one pivoting direction and biased by a spring in the other pivoting direction for engagement of the drive-transmitting friction linings with one another. According to this embodiment, the stop member acts exactly opposite to the biasing direction of the spring tending to pivot the carrier plate about its pivot axis.

Since it is in any case customary to provide a certain spacing between the stationary support member of the device and the storage body, this spacing may be profitably employed for mounting the carrier plate therein, so that the tubular projection thereof projects into the storage body. This arrangement also provides for simple assembly and disassembly of the device.

Particularly advantageous with a view to facility of construction is a further embodiment wherein the other bar drum is formed as a hollow cylinder carrying an annular drive-transmitting friction lining on its interior wall surface, and wherein the drive shaft carries a friction wheel at the level of the drive-transmitting friction lining, with a complementary friction lining being located on the outer periphery of the friction wheel and having an outer diameter smaller than the interior diameter of the drive-transmitting friction lining. According to this embodiment, the drive transmitting friction surfaces come into mutual engagement only when it is actually required to rotate the other bar drum. At all other times the other bar drum that is the storage body, will remain stationary as the drive shaft rotates at constant speed.

A further important characteristic is the location of the drive transmitting friction surface closely adjacent the rotary mounting of the other bar drum since this results in a desirably short lever arm between these two portions, enabling the rotary mounting to readily absorb the forces acting thereon.

BRIEF DESCRIPTION OF THE DRAWINGS

An embodiment of the invention shall now be described with reference to the accompanying drawings, wherein.

DETAILED DESCRIPTION

Figure 1:
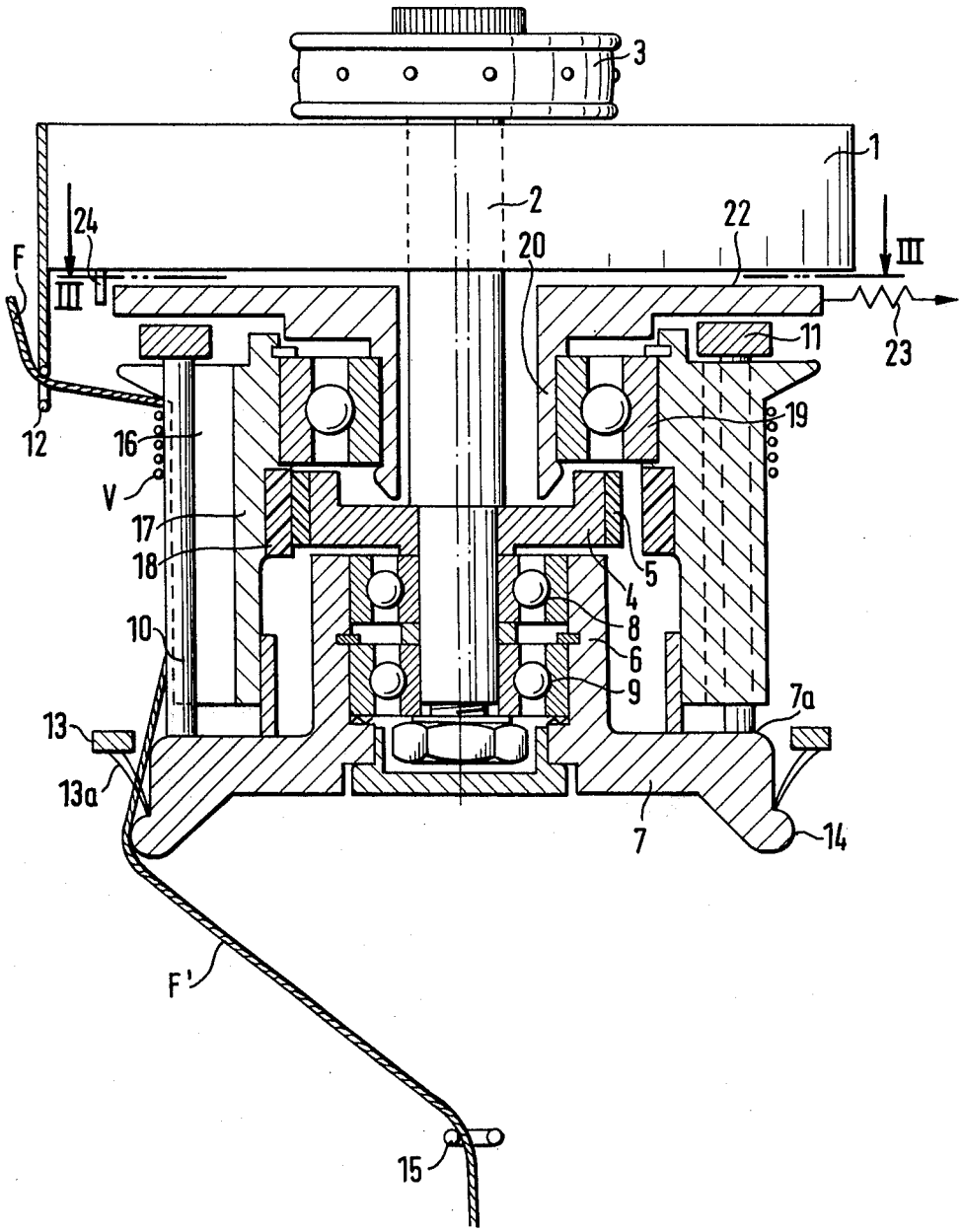
FIG. 1 shows a partially cut lateral view of the storing device.

The storing and feeding device according to the invention has a driving shaft 2 which is rotatable in a stationary housing 1, and which in a way known per se is driven by a drive pulley 3 fixed to the driving shaft 2 continuously in synchronism with and by the central drive system of the textile machine, for example by the shaft driving the needle cylinder and the rib cylinder in a circular knitting machine. A friction wheel 4 is unrotatably fixed to said driving shaft 2, and is on its outer periphery provided with a friction lining 5 of a material with a high friction coefficient. On said driving shaft 2 there is also a sleeve portion 6 of a bottom hub plate 7 rotatably journalled by means of two ball bearings 8 and 9. In the upper surface 7*a* of the bottom hub plate 7 are the lower ends of a number of bars 10 attached, equally spaced over the periphery of bottom hub plate 7. The upper ends of the bars 10 are attached to an annular upper hub plate 11. Thus, all the bars 10 form together, in a way known per se, a bar cage or drum, on which a thread F coming from a thread supply, not shown here, can be tangentially wound via a stationary eyelet 12 for building up an intermediate supply V of thread, from which the textile machine in question, for example a knitting machine (not shown here) can pull off thread F′ axially according to its own demand of thread, via a brake ring 13 with elastic fingers 13*a* over a withdrawal rim 14 on the bottom hub plate 7, and further through a withdrawal eyelet 15 which is coaxial with the driving shaft 2.

Radial ribs or bars 16 project between the bars 10, there being as many ribs 16 as there are bars 10, whereby the inner edges of these ribs 16 are connected by means of a cylinder 17 which surrounds the driving shaft 2 and the friction wheel 4. The cylinder 17 and the ribs 16 form together one single component in the device. Due to the eccentric mounting of the drum 17, some of the ribs 16 project radially beyond the bars 10 for engagement with the thread store V. On the inner surface of said cylinder 17*a* second friction lining 18 is attached, which can be brought into engagement with the first friction lining 5 on the friction wheel 4. When the two friction linings 5 and 18 are engaged, the cylinder 17 with its ribs 16 will rotate with the friction wheel 4 on the driving shaft 2. Due to the projection of the ribs 16 between the bars 10 the drum or cage formed by these bars 10 and the bottom hub plate 7 attached thereto also rotate.

Figure 2:
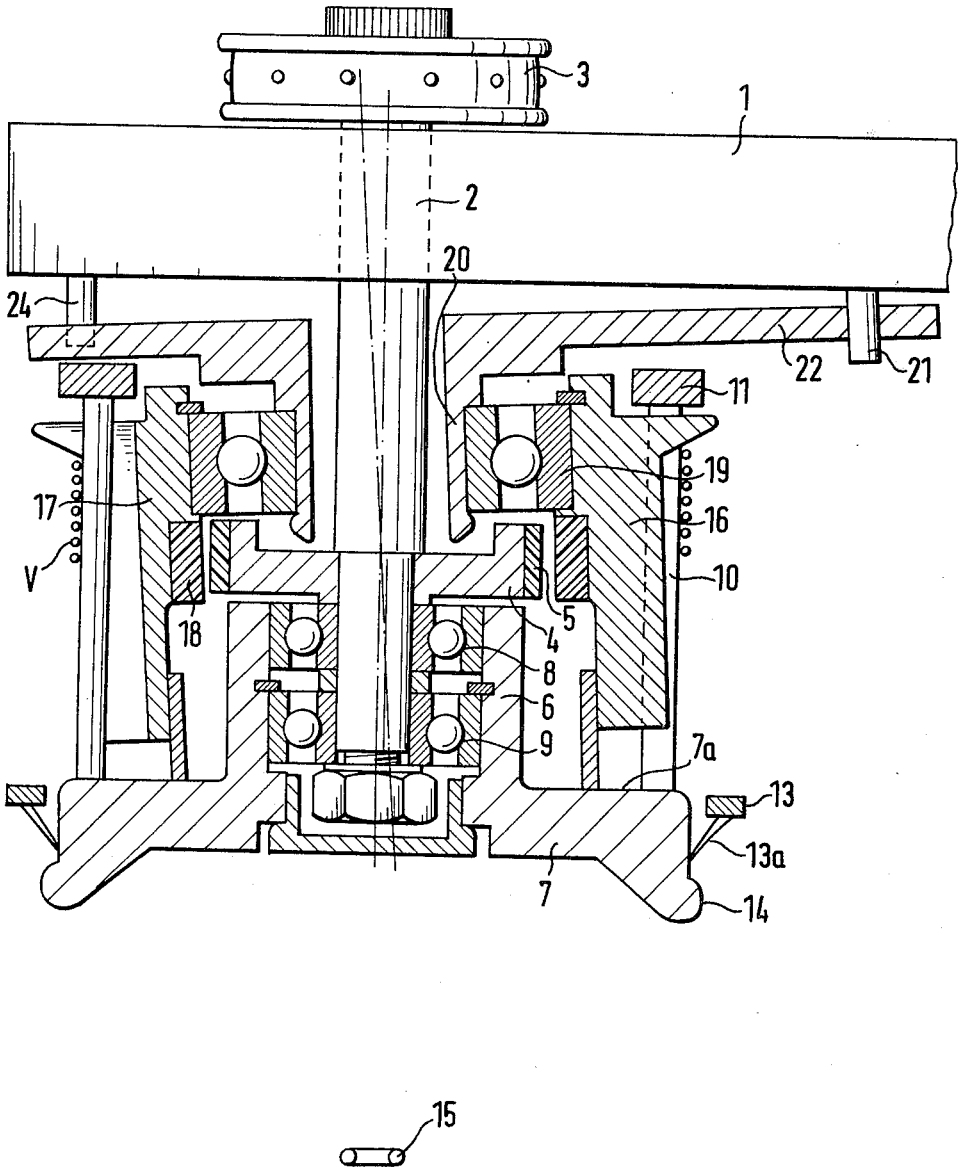
FIG. 2 shows an also partially cut lateral view perpendicular to the view in FIG. 1.
Figure 3:
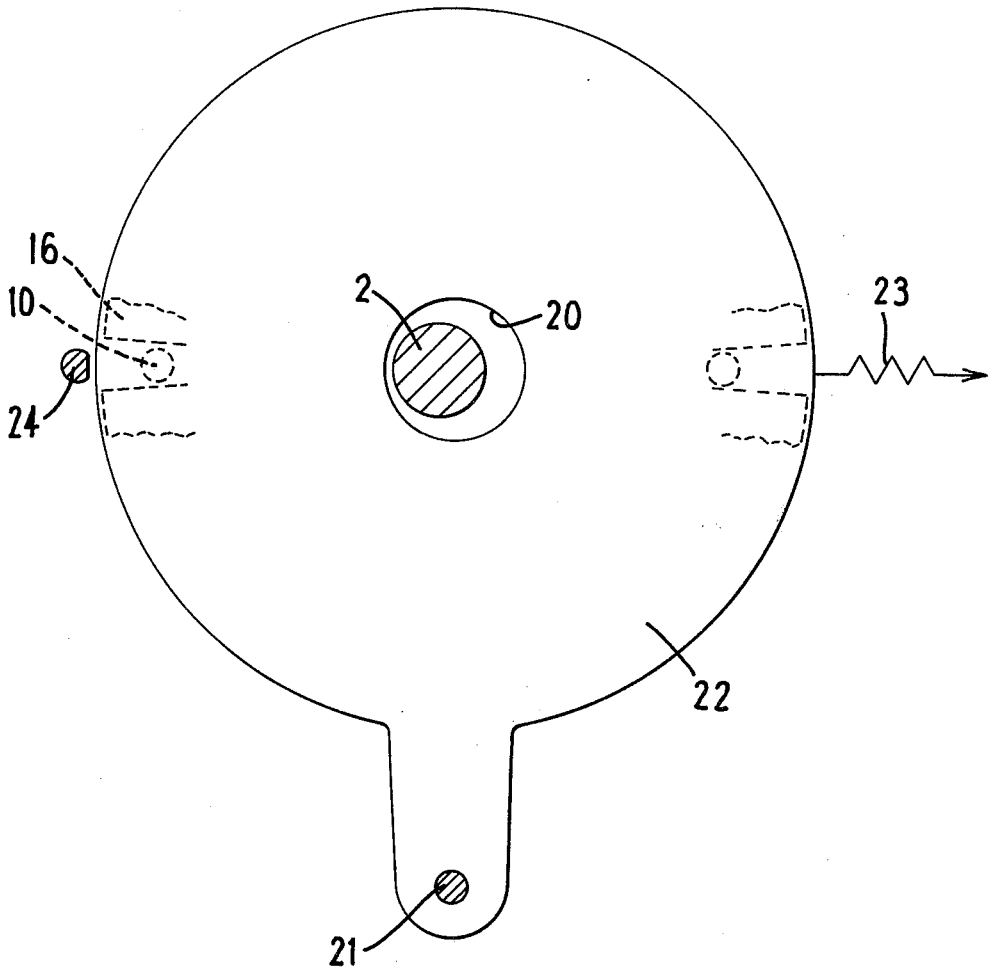
FIG. 3 shows a top plan view of the plate 22 as taken substantially along line III—III in FIG. 1.

The rib or bar drum 17 formed by the ribs 16 is rotatably journalled by means of a ball bearing 19 on a portion 20, formed like a sleeve, of a plate 22 which is pivotable around a pin 21 (see FIG. 2). The pivotal movement of the plate 22 is carried out against the action of a spring 23 shown schematically in FIG. 1, and said movement is limited by means of a stop pin 24, also shown schematically in the drawings. The pin 21 is so arranged in the stationary housing 1 that its axis is not completely parallel to the centre axis of the driving shaft 2. This means that the rib drum 17 will be slightly inclined relative to the bar drum 10, which can be seen from FIG. 2. Moreover, the force in the spring 23 and the position of the step 24 are so chosen that the plate 22 and therefore also the rib drum 17 will be somewhat eccentric relative to the bar drum 10 which is coaxial with the driving shaft 2. Said eccentricity can be seen in FIG. 1. This technique of relative inclination and eccentricity, which is principally known per se, between the bar drum 10 and the rib drum 17 causes about an axial displacement of the intermediate thread supply V towards the bottom hub plate 7, whereby the respective thread windings will be displaced in parallel relative to each other, that is there will be no overlapping between the thread windings during the displacement of thread in the device.

OPERATION

The thread storing- and feeding device according to the invention works in the following way. The thread windings wound on will, due to being wrapped around the rib drum 17 and bar drum 10 and due to the eccentricity between these two drums, exert a force (wrapping force) on the rib drum 17, which force seeks to move the rib drum 17 to the left in FIG. 1, against the action of the spring 23.

When the thread supply V wound on is small, that is when the number of thread windings on the storing device is small, said wrapping force will not be sufficiently strong to overcome the action of the spring 23, whereby the rib drum 17 will take the position shown in FIG. 1. As can be seen there, the friction lining 18 will thereby be in engagement with the friction lining 5, which means that both the rib drum 17 and the bar drum 10 will rotate with the friction wheel 4 on the driving shaft 2. This will thus cause the thread F be wound up on the device, which means that the thread supply V will successively increase, provided that the rotation speed of the driving shaft 2 is chosen so that it corresponds to a winding on speed which exceeds the speed with which the textile machine is consuming or withdrawing thread from the storing device.

As the number of thread windings V wound on drum 17 is increasing, the wrapping force that is exerted on the rib drum 17 relative to the bar drum 10 by the thread windings will increase, and when the thread supply reaches a certain amount the rib drum 17 will move to the left in FIG. 1 so that the friction lining 18 will be moved out of its engagement with the frication lining 5, whereby the rib drum 17 and thus also the bar drum 10 will cease to rotate with the friction wheel 4 on the driving shaft 2. At this moment, the winding of the thread F on to the storing device will cease. The textile machine will, however, continue to consume thread F′ from the supply V on the storing device as before and this supply V will soon decrease to such an extent that the wrapping force in turn will be reduced to such a value that the spring 23 will again be able to bring the friction lining 18 into engagement with friction lining 5. The thread F will thereby start to be wound up again, and thereafter the above described course of operation will take place again.

In practice, due to the rapid variations in the amount of thread on the storing device and due to mechanical inertia of the components in the device, a kind of an equilibrium state will be reached as far as the engagement between the two friction surfaces 5 and 18 is conconcerned. In other words, the friction linings 5 and 18 will not under normal operation be in repeated discrete engagement and disengagement positions, but there will rather be a state of continuous slip between the linings. This will result in the drums 17 and 10, that is the storing device, rotating continuously with continuous winding-on of thread as a consequence (when there is continuous thread consumption to the textile machine), whereby the rotation speed of the storing device will automatically adapt itself to the average speed with which the textile machine in question is consuming thread from the storing device.

I claim:

1. A thread storing and feeding device, particularly for textile machines with intermittent thread consumption, comprising:

a thread storage body mounted for rotation about a first axis and adapted to store thread windings therearound, said windings being wound tangentially onto said body and unwound therefrom in an axial direction;

said storage body having first and second drums, said first drum having circumferentially spaced slots formed therein and said second drum having bars which project into said slots for rotatably driving said first drum from said second drum, and said second drum being mounted with its longitudinal central axis disposed in inclined and eccentric relationship relative to said first axis;

mounting means supporting said second drum for movement relative to said first drum in response to the quantity of thread windings stored therearound; and drive means for controlling the rotational speed of said body in response to the relative position between said drums to thereby control the thread windings around said body, said drive means including a rotatable drive shaft having a driving friction lining thereon, and a driven friction lining fixed to said second drum and engageable with said driving friction lining in response to relative movement between said drums to effect rotational driving of said body.

2. A device according to claim 1, wherein said mounting means includes a spring-urged carrier member movably mounted on a stationary support, said second drum being rotatably mounted on said carrier member, whereby movement of said carrier member permits the axis of said second drum to be adjusted with respect to said first axis.

3. A device according to claim 2, wherein said carrier member is mounted for limited pivotal movement relative to said stationary support about a pivot axis which is radially spaced from said first axis and is inclined relative thereto, whereby said pivot and first axes define an acute angle therebetween.

4. A device according to claim 3, wherein said pivot axis is defined by a mounting pin which extends between said stationary support and said carrier member for permitting limited pivotal movement therebetween.

5. A device according to claim 4, wherein said pin is spaced radially from said first axis by a distance which is greater than the radius of said storage body.

6. A device according to claim 3, wherein said carrier member is adapted to abut a fixed stop for limiting the pivotal displacement thereof in one pivoting direction, and is biased by a spring in the other pivoting direction for engagement of said friction linings with one another in drive-transmitting relationship.

7. A device according to claim 3, wherein said carrier member is positioned between said support and said body, and said carrier member having a tubular hub portion which projects into said storage body and rotatably mounts said second drum thereon in surrounding relationship thereto.

8. A device according to claim 7, wherein said drive shaft is rotatably mounted on said support and projects therefrom in a cantilever manner so as to extend axially through both said first and second drums, and said first drum being rotatably mounted on said drive shaft adjacent the free end thereof.

9. A device according to claim 1, wherein said second drum is formed as a hollow cylinder, said driven friction lining being of an annular configuration and mounted on an interior wall surface of said hollow cylinder, and said drive shaft having a drive wheel secured thereto and positioned within said hollow cylinder, said drive wheel having said driving friction lining on the outer periphery thereof and positioned substantially within and surrounded by said driven friction lining, said driving friction lining having an outer diameter which is smaller than the interior diameter of said driven friction lining.

10. A device according to claim 9, wherein said first drum is rotatably supported on said drive shaft, and said friction wheel being mounted on said drive shaft axially between the mounting for said first drum and a shoulder on said drive shaft.

11. A device according to claim 7, wherein said tubular hub portion defines an enlarged opening which extend through said carrier member, and said drive shaft being positioned within and extending through said enlarged opening.

12. A device according to claim 1, wherein the rotational axis of said drive shaft defines said first axis, said first drum being rotatably supported on said drive shaft, said first drum being relatively hollow and having a peripheral wall defined by a plurality of axial elongated bars disposed in circumferentially spaced relationships so as to define longitudinally elongated slots which open radially outwardly between adjacent bars, said second drum being positioned substantially within and in eccentric relationship relative to said first drum, said second drum having a hollow cylinder to which are secured a plurality of barlike projections which project radially outwardly from said cylinder into the radial slots of said first drum, at least some of said barlike projections extending radially outwardly through the slots of said first drum for engagement with the surrounding thread windings, said driving friction lining being of an annular configuration and coaxially and nonrotatably secured to said drive shaft, said driven friction lining being of an annular configuration and coaxially and nonrotatably fixed to said second drum, said annular friction linings being positioned one inside of the other and being of different diameters so as to be movable into frictional driving engagement with one another in response to movement of said second drum eccentrically with respect to said first drum.

13. A device according to claim 12, wherein said first drum is adjacent one end thereof rotatably supported on said drive shaft, said mounting means including a carrier plate positioned adjacent the other end of said first drum, said carrier plate including a hollow hub portion which surrounds said drive shaft and projects into the interior of said second drum, bearing means for rotatably supporting said second drum on said hollow hub portion, said carrier plate being pivotally supported on a stationary mounting member for limited pivotal movement within a plane which intersects and extends transverse with respect to said first axis, and a spring pivotally urging said carrier plate in a first pivotal direction within said plane for normally maintining said friction linings in driving engagement with one another, said carrier plate being pivoted in the opposite direction in response to the build-up of thread windings on said thread body.

14. A thread storing and feeding device, particularly for a textile machine with intermittent thread consumption, comprising:

drive shaft means rotatable about a first axis;

rotatable drumlike body means for permitting a thread to be tangentially wound thereon to form a thread storage of several windings therearound with the thread being unwound therefrom in an axial direction;

said body means including a first drum which is coaxial with and rotatably supported for rotation about said first axis, said first drum having a plurality of longitudinal slots formed therein in angularly spaced relationship therearound., said slots extending radially through the drum and being spaced apart by intermediate bars, and said thread storage being wrapped around the periphery of said first drum so as to extend across said slots;

said body means including a second drum having a portion positioned at least partially within said first drum, said portion including a plurality of second bars disposed in angularly spaced relationship therearound and projecting radially outwardly into the slots of said first drum for nonrotatably coupling said first and second drums together, said second drum being eccentrically positionable relative to said first drum so that some of said second bars project radially through said slots for engagement with the surrounding windings of the thread storage;

mounting means supporting said second drum with its longitudinal central axis disposed in nonaligned relationship relative to said first axis and for permitting movement of said second drum within a plane which is substantially perpendicular to said longitudinal central axis, whereby said second drum is movable radially relative to said first drum;

drive means for driving said second drum from said drive shaft means to effect rotation of said first drum about said first axis, said drive means including first and second annular friction rings nonrotatably connected to said drive shaft means and said second drum respectively, said first and second annular friction rings being positioned one within the other and being of different diameters;

spring means normally biasing said mounting means and said second drum into a first position wherein said second drum is radially eccentrically positioned relative to said first drum so that said first and second friction rings are in driving engagement to rotatably drive said body means to wind thread therearound; and said mounting means and said second drum mounted thereon being movable, in response to a build-up in the number of windings in said thread storage, against the urging of said spring means into a second position wherein said friction rings are drivingly disengaged from one another to drivingly disconnect said body means from said drive shaft means.

15. A device according to claim 14, wherein said mounting means includes a mounting member mounted for pivotal movement about a pivot axis which is positioned radially outwardly from the periphery of said first drum, said second drum being mounted on said mounting member so that its central longitudinal axis is substantially parallel with said pivot axis.

16. A device according to claim 15, wherein said pivot axis extends at a small acute angle relative to said first axis.

17. A device according to claim 15, wherein said mounting member is of a platelike construction positioned adjacent one end of said body means and having a sleevelike hub which projects into one end of said body means, said second drum being rotatably supported on said hub, said hub defining an enlarged central opening therethrough, said drive shaft means projecting through said central opening and having an end portion disposed coaxially within said first drum, said first drum being rotatably supported on the end portion of said drive shaft means.

18. A device according to claim 17, wherein said second friction ring is secured to the inside of said second drum and defines an interior annular friction surface which surrounds and is of larger diameter than an exterior annular friction surface as defined on said first annular friction ring, said first annular friction ring being coaxially and nonrotatably secured to said drive shaft means and positioned within the interior of said body means.

19. A device according to claim 18, wherein said pivot axis extends at a small actue angle relative to said first axis.

* * * * *